US005439194A

United States Patent [19]

Lankford

[11] Patent Number: 5,439,194

[45] Date of Patent: Aug. 8, 1995

[54] LOW PROFILE MOUNTING APPARATUS, FOR GAS MASKS OR OTHER DEVICES

[76] Inventor: Alan D. Lankford, 21314 Four Oaks Dr., Houston, Tex. 77073

[21] Appl. No.: 184,589

[22] Filed: Jan. 21, 1994

[51] Int. Cl.[6] ..... A47F 5/00

[52] U.S. Cl. ..... 248/309.1

[58] Field of Search ..... 248/309, 314, 316.1, 248/220, 682

[56] References Cited

U.S. PATENT DOCUMENTS

| | | | |
|---|---|---|---|
| 3,443,783 | 5/1969 | Fisher | 248/220.5 |
| 3,858,996 | 1/1975 | Jarvis | 403/353 |
| 3,986,780 | 10/1976 | Nivet | 403/353 |
| 4,192,478 | 3/1980 | Coules | 248/222.3 |
| 4,372,517 | 2/1993 | Welch et al. | 248/267 |
| 4,527,760 | 7/1985 | Salacuse | 248/108 |
| 4,653,708 | 3/1987 | Rich | 248/27.1 |
| 4,684,096 | 8/1987 | Tanaka | 248/309.1 |
| 4,860,905 | 8/1989 | Schott et al. | 211/59.1 |
| 4,963,921 | 10/1990 | Kariya et al. | 355/53 |
| 5,167,465 | 12/1992 | Inui et al. | 403/317 |
| 5,188,324 | 2/1993 | Joseph et al. | 248/222.3 |

*Primary Examiner*—Ramon O. Ramirez
*Attorney, Agent, or Firm*—Derek R. Van Gilder

[57] ABSTRACT

A gas mask mounting apparatus and method for securing a gas mask or other breathing apparatus to a panel in a vehicle or building wherein said mounting apparatus is fixed to the panel, wall, or suitable surface, and said mounting apparatus has two rounded flanges formed on each side of said mounting apparatus and an aperture with two flanges is further formed in the gas mask or breathing apparatus wherein said aperture in said gas mask or breathing apparatus may be inserted over the two rounded flanges of the mounting apparatus and said gas mask or breathing apparatus may be rotated until the two flanges of the gas mask are captured between an inner surface of the mounting device and the two rounded flanges of the mounting device thus locking the gas mask or breathing apparatus to the hanger fixed to the panel or wall.

5 Claims, 4 Drawing Sheets

LOW PROFILE MOUNTING APPARATUS, FOR GAS MASKS OR OTHER DEVICES

BACKGROUND OF THE INVENTION

There are many mounting or hanger designs available today. Some of these designs typically are hangers that insert directly into a panel such as JOSEPH et al U.S. Pat. No. 5,188,324 and NIVET U.S. Pat. No. 3,986,780; this could be difficult in a vehicle such as a fire truck, ambulance, or helicopter, due to wireways, tubing, or critical components behind the panel. Other hangers typically require a special apparatus by which to hang or support an object on such as SALACUSE U.S. Pat. No. 4,527,760. This type of hanger or adjustable clip system takes up more valuable space in a fire truck or an ambulance and therefore is not practical for an ambulance or fire truck.

SUMMARY

It is the object of this invention to provide a low profile mounting apparatus suitable for mounting in an ambulance, fire chief's car, fire truck, helicopter or other place that will allow a user of the gas mask, breathing apparatus or other device to quickly remove the gas mask, breathing device or other device from a convenient location in the ambulance, fire truck or other vehicle or also to quickly replace the gas masks, breathing device or other device in its proper location.

It is another object of this invention to provide a rigid hanger that will prevent a gas mask, breathing apparatus or other device from moving on a shelf or in a locker in a vehicle when the vehicle is moving.

It is still another object of the present invention to provide a low profile hanger for a gas mask, breathing apparatus or other apparatus in a vehicle such as an ambulance, fire truck or fire chief's vehicle, helicopter or boat.

The features of the present invention can be best understood together with further objects and advantages by reference to the following descriptions taken in conjunction with the accompanying drawings, wherein like numerals indicate like parts.

DETAILED DESCRIPTION OF THE PREFERRED EMBODIMENT

Figure 1:
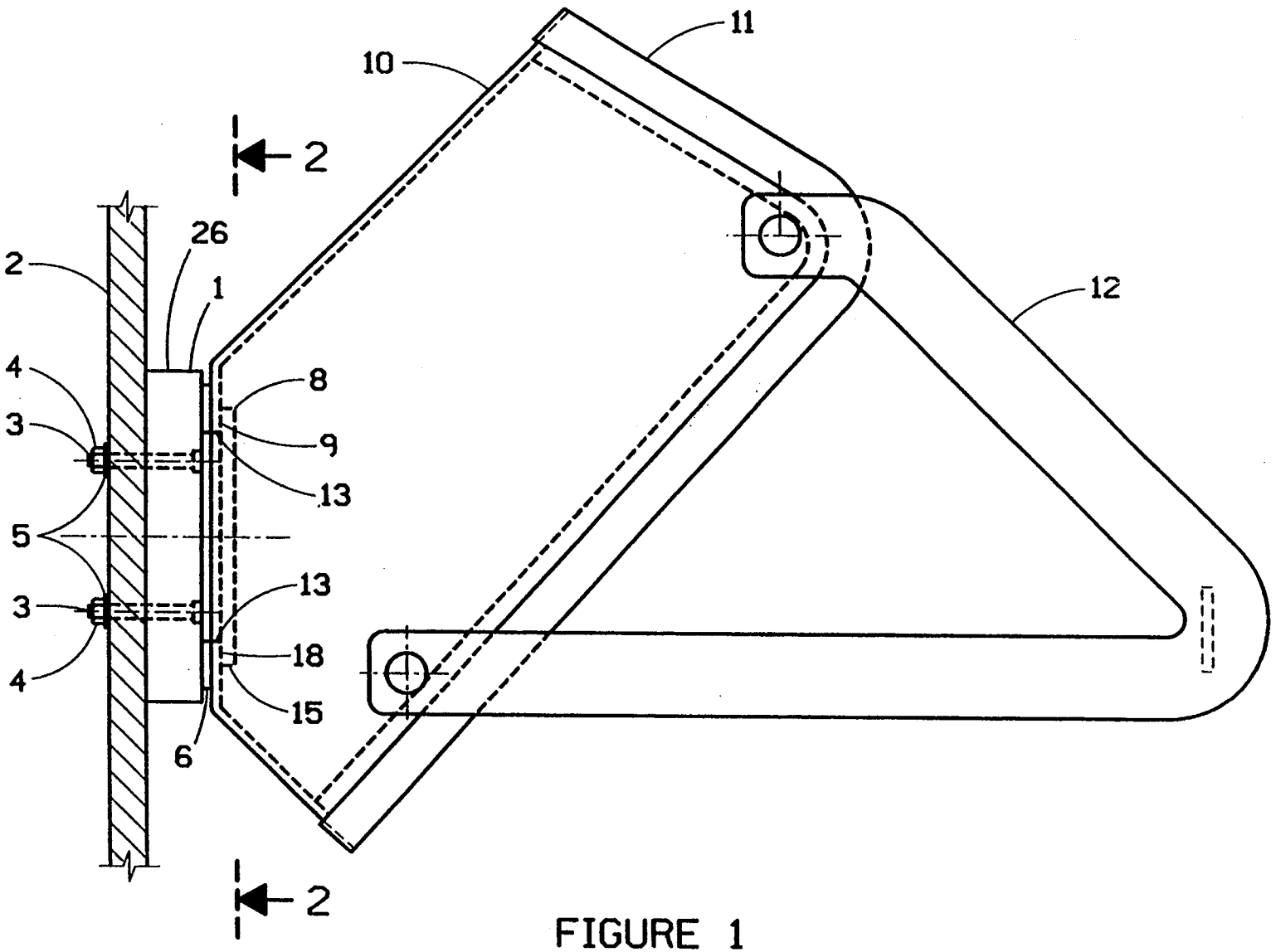
FIG. 1 is a section elevation of a gas mask being supported by the apparatus and a panel.

Referring to FIG. 1 there is shown a body 26 of the low profile mounting apparatus 1 suitably fixed to a panel 2, wall or other desirable surface.

The low profile mounting apparatus 1 is shown suitably fixed to the panel 2 by bolts 3, nuts 4 and washers 5 by design choice, however, self tapping set screws, adhesive or other suitable material or devices could also be used by design choice.

A gas mask 10 or other desireable device is shown on the body 26 of the low profile mounting apparatus 1 being held in place by a first rounded flange 8 and the second rounded flange 15 that is shown formed on a shaft 13 of the low profile mounting apparatus 1 or suitably fixed to the shaft 13 by design choice. The first straight flange 9 and the second straight flange 18 of the gas mask 10 is shown being compressed between a resilient ring 6 and the first rounded flange 8 and the second rounded flange 15 of the low profile mounting apparatus 1 thereby preventing the gas mask 10 or other desireable device from rotating or loosely rattling.

The gas mask 10 or other desireable device is shown with the gas mask frame 11 and head straps 12 for reference purposes only.

The low profile mounting apparatus 1 is shown comprised of a body 26, a shaft 13, a first rounded flange 8, and a second rounded flange 15.

Figure 2:
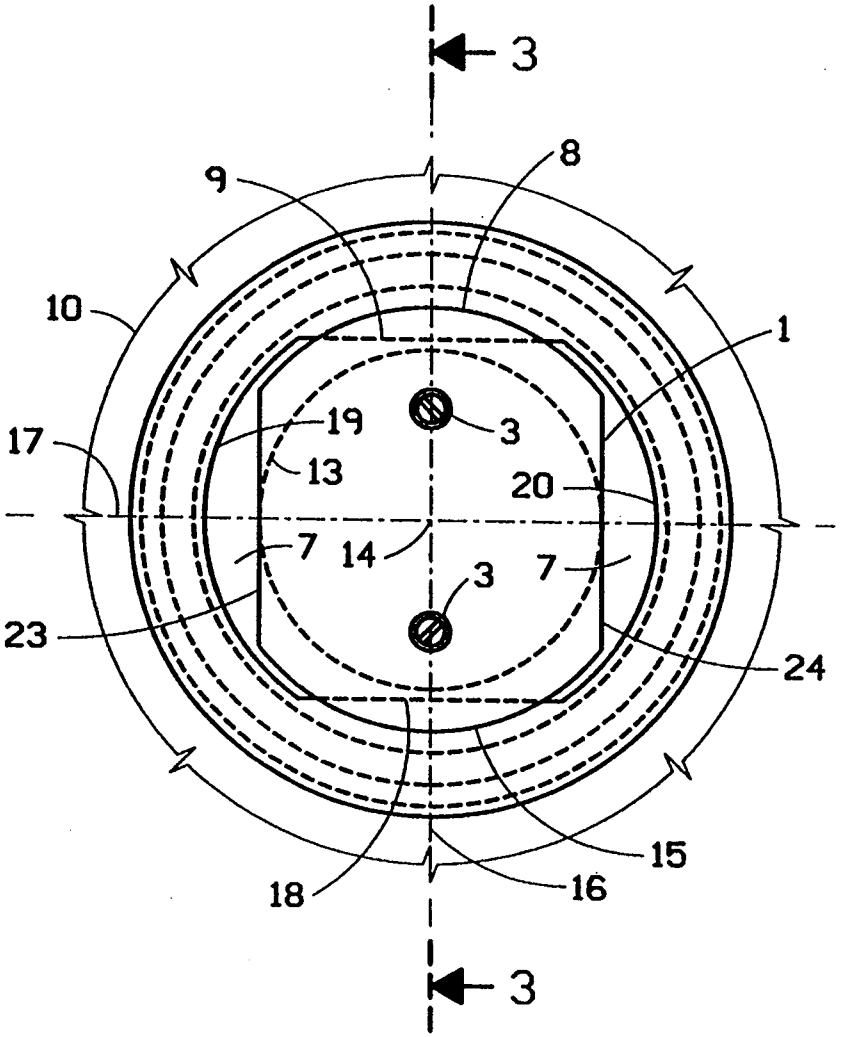
FIG. 2 is a section elevation of the apparatus as taken through FIG. 1.

Referring to FIG. 2 there is shown a section view of the first end of the gas mask 10 with the first straight flange 9 being restrained by the first rounded flange 8 at the first side of the low profile mounting apparatus 1. A second straight flange 18 is shown being restrained by a second rounded flange 15 at the second side of the low profile mounting apparatus 1. A third side 23 and a fourth side 24 of the low profile mounting apparatus 1 are both straight sides.

The shaft 13 is shown with hidden lines and is further shown centered on a center axis 14. The center axis 14 is shown made up of a first center line 16 and a second center line 17. The center axis 14 also is the center of the arcs that form the first rounded flange 8 and the second rounded flange 15 of the low profile mounting apparatus 1.

An aperture 7 of the gas mask 10 or other desirable device is shown formed in the first end of the gas mask 10 and is defined by a third arc 19 on a third side of the aperture 7 and a fourth arc 20 on a fourth side of the aperture 7. A first straight flange 9 defines a first side of the aperture 7 and a second straight flange 18 defines the second side of the aperture 7.

The bolts 3 are shown within the circumference of the shaft 13. The bolts 3 can be located within the shaft area by design choice. The number of the bolts 3 used is by design choice although other suitable means of fixing the low profile mounting apparatus 1, such as adhesive, is by design choice.

Figure 3:
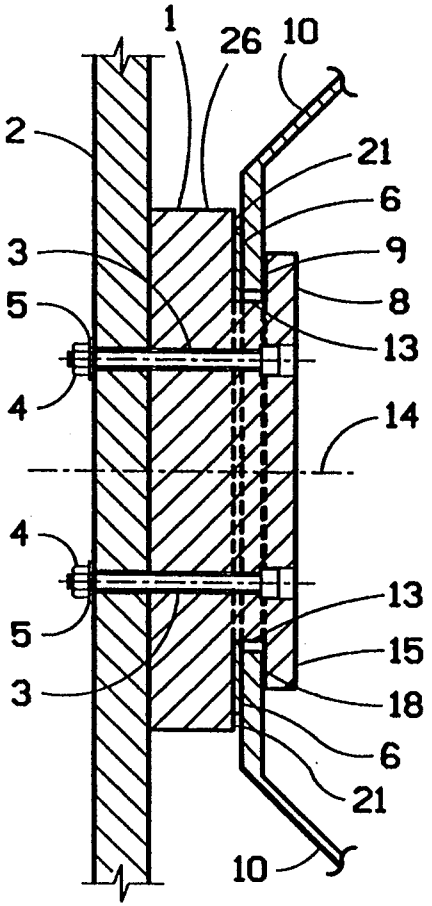
FIG. 3 is a section elevation of the apparatus as taken through FIG. 2.

Referring to FIG. 3 there is shown a section elevation as taken through FIG. 2.

The low profile mounting apparatus 1 is shown suitably fixed to the panel 2 by the bolts 3, the nuts 4 and the washers 5. However, it could also be fixed to the panel 2 by self tapping screws or expansion anchors.

The center axis 14 is shown extending from a first end of the low profile mounting apparatus 1 disposed on the panel 2 to a second end of the low profile mounting apparatus 1 near the first rounded flange 8, the second rounded flange 15 and the body 26.

The first straight flange 9 of the gas mask 10 or other desirable device is shown disposed between the first rounded flange 8 and a resilient ring 6. The second straight flange 18 of the gas mask 10 or other desirable device is shown disposed between the second rounded flange 15 and the resilient ring 6. The resilient ring 6 is shown suitably fixed to the inner surface 21 of the body 26 of the low profile mounting apparatus 1. As shown in FIG. 3 the gas mask 10 or other desireable device is restrained from moving vertically by the shaft 13 near the first straight flange 9 and the second straight flange 18. The shaft 13 is shown with a first end suitably fixed to the body 26 and the second end suitably fixed to the first rounded flange 8 and the second rounded flange 15.

Figure 4:
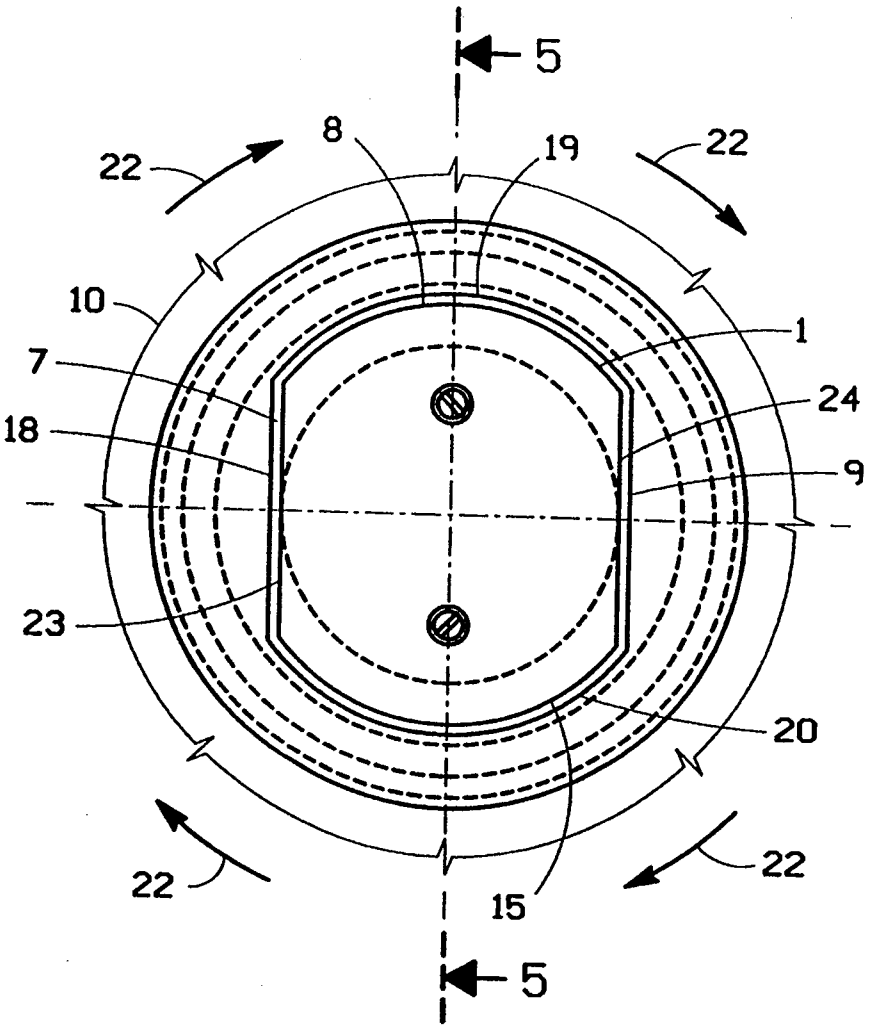
FIG. 4 is a section elevation similar to FIG. 2 showing the gas mask being removed.

Referring to FIG. 4, there is shown an elevation view similar to FIG. 2, however the gas mask 10 or other desireable device is shown rotated 90 degrees in a clockwise direction 22. Although it is shown rotated in the clockwise direction 22, it could also be rotated in a counter clockwise direction not shown.

When the gas mask 10 or other desireable device is rotated 90 degrees, the aperture 7 aligns and conforms to the shape of the first rounded flange 8 and the second rounded flange 15.

The first rounded flange 8 aligns and conforms to the configuration of the third arc 19 and the second rounded flange 15 aligns and conforms to the configuration of the fourth arc 20. The third side 23 and the fourth side 24 of the aperture 7 are also parallel to the first straight flange 9 and the second straight flange 18. When the gas mask 10 or other desirable device is in the position relative to the low profile mounting apparatus 1 as shown in FIG. 4 & 5, it is not restrained or captured, the gas mask 10 or other desireable device is now in a position to be removed or the gas mask 10 or other desirable device could also be in a position to rotate 90 degrees to be suitably secured to the panel by the low profile gas mask mounting apparatus 1.

Figure 5:
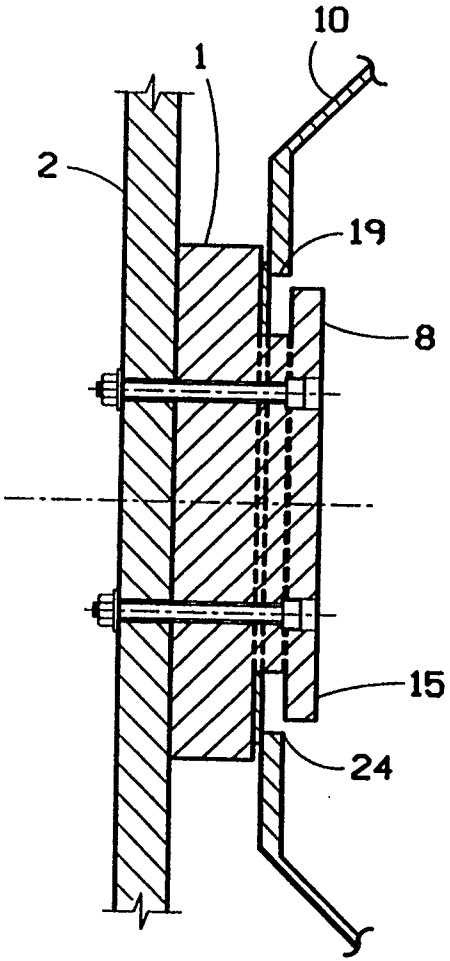
FIG. 5 is a section elevation as taken through FIG. 4.

Referring to FIG. 5 there is shown a section elevation as taken through FIG. 4.

The gas mask 10 or other desirable device is rotated 90 degrees relative to the low profile gas mask mounting apparatus 1 that is shown suitably fixed to the panel 2. The third arc 19 is shown to be disengaged with the first rounded flange 8 and the fourth arc 24 is further shown to be disengaged with the second rounded flange 15. The gas mask 10 or other desireable device is not restrained to the low profile mounting apparatus 1 and can be removed from the low profile mounting apparatus 1 for use or further rotated 90 degrees to secure the gas mask 10 or other desireable device to the low profile mounting apparatus 1 and the panel 2.

Figure 6:
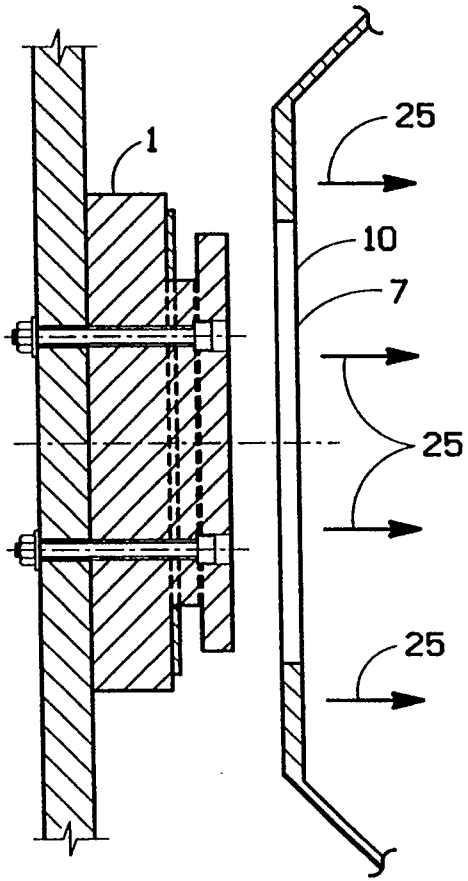
FIG. 6 is a section elevation view showing the gas mask being removed from the mounting apparatus and panel.

Referring to FIG. 6 there is shown another section elevation similar to FIG. 5.

The gas mask 10 or other desireable device has been withdrawn in a direction away 25 from the low profile mounting apparatus 1 and the panel 2 for further use; the gas mask 10 or other desireable device would also be moved in the opposite direction when placing the gas mask 10 or other desireable device on the low profile mounting apparatus 1.

When the gas mask 10 or other desirable device is in use, other devices, not shown, are inserted into the aperture 7.

Figure 7:
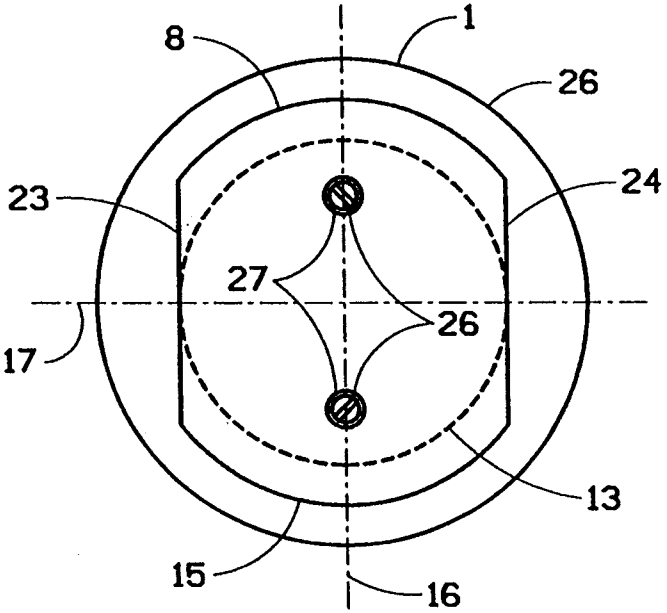
FIG. 7 is a frontal elevation of the apparatus.

Referring to FIG. 7 there is shown an elevation view of the low profile mounting apparatus 1 for clarity and reference.

The body 26 is shown as being solid and round in configuration however, it could be square, rectangular, triangular, or cylindrical in shape or configuration by design choice.

The first rounded flange 8 is shown near the first side, the second rounded flange 15 is shown near the second side, the third side 23 and the fourth side 24 are all shown on the low profile mounting apparatus 1. The shaft 13 is shown behind the first rounded flange 8 and the second rounded flange 15. The counter sink holes 27 and the bolt holes 28 are shown formed in the shaft 13 and the body 26 of the low profile mounting apparatus 1.

The first center line 16 and the second center line 17 are shown for reference.

Figure 8:
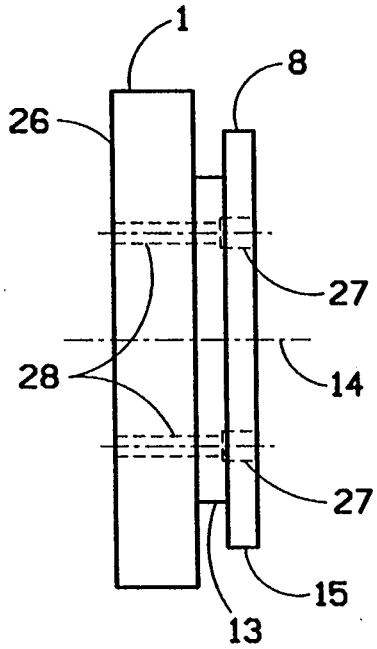
FIG. 8 is a side elevation showing the unmounted apparatus as taken through FIG. 7.

Referring to FIG. 8 there is shown a side elevation view of the low profile mounting apparatus 1 for clarity and reference.

The body 26 is shown with a first end and a second end and the shaft 13 is further shown suitably fixed or formed on the second end of the body 26 at the first end of the shaft 13. The first rounded flange 8 and the second rounded flange 15 are shown with a first end fixed to the second end of the shaft 13. The second end of the first rounded flange 8 and the second rounded flange 15 is shown as a flat surface by design choice.

The center axis 14 is shown extending from the first end of the body 26 through the shaft 13 and through the second end of the first rounded flange 8 and the second rounded flange 15. The counter sink holes 27 and the bolt holes 28 are formed in the body 26, the shaft 13, and the first rounded flange 8 and the second rounded flange 15.

Although the system described in detail supra has been found to be most satisfactory and preferred, many variations are possible. For example, the low profile mounting apparatus could be square or rectangular in configuration.

Although the invention has been described with reference to the preferred embodiment, it will be understood by those skilled in the art that additions, modifications, substitutions, deletions, and other changes not specifically described may be made in the embodiments herein. It should be further understood that the details herein are to be interpreted as illustrative and are not in a limiting sense.

What is claimed as invention is:

1. A low profile mounting apparatus mounted on a panel for securing a gas mask having at least one aperture formed in said gas mask to said panel comprising of:

a body having a first end and a second end;

a center axis wherein said center axis extends from said first end of said body through said second end of said body;

a shaft with a first end and a second end wherein said shaft is fixed to said body at said first end and further is a part of said body wherein said first end of said shaft is nearer to said first end of said body and said second end of said shaft is near said second end of said body;

at least one rounded flange wherein said rounded flange is formed at said second end of said shaft, and said rounded flange extends circumferentially from said center axis to form an arc past said shaft, said rounded flange further has at least one side that is not rounded and wherein said rounded flange is further formed to essentially the same configuration as said aperture formed on said gas mask, but said aperture is greater than said rounded flange wherein said aperture may be placed around said rounded flange and said shaft and wherein said aperture is further rotated until part of said aperture is between said rounded flange and said inner surface of said rounded flange, thereby capturing said aperture between said rounded flange and said inner surface of said rounded flange, thereby mounting said aperture and said gas mask to said panel.

2. The low profile mounting apparatus of claim 1 wherein a resilient ring is suitably fixed to said inner surface wherein said resilient ring is compressed by the said gas mask whenever said gas mask is placed between said inner surface and said rounded flange.

3. The low profile mounting apparatus of claim 1 wherein holes are formed near the center of said body and bolts are inserted into said holes; and said bolts are further inserted into a panel and said low profile mounting apparatus is further fixed to said panel with said bolts.

4. The low profile mounting apparatus of claim 1 wherein said low profile mounting apparatus is fixed to a said panel with adhesive.

5. The low profile mounting apparatus of claim 1 wherein said low profile mounting apparatus is fixed to a panel, wall, or other flat surface with self tapping set screws.

* * * * *